US005152261A

United States Patent [19]

Butterfield et al.

[11] Patent Number: 5,152,261

[45] Date of Patent: Oct. 6, 1992

[54] VARIABLE CAMSHAFT TIMING SYSTEM UTILIZING CHANGES IN LENGTH OF PORTIONS OF A CHAIN OR BELT

[75] Inventors: Roger P. Butterfield, Interlaken; Franklin R. Smith, Slaterville Springs, both of N.Y.

[73] Assignee: Borg-Warner Automotive Transmission and Engine Components Corp.

[21] Appl. No.: 790,619

[22] Filed: Nov. 7, 1991

[51] Int. Cl.[5] ..... F01L 1/34

[52] U.S. Cl. ..... 123/90.15; 123/90.31; 123/502

[58] Field of Search ..... 123/90.15, 90.17, 90.31, 123/502, 508

[56] References Cited

U.S. PATENT DOCUMENTS

| | | | |
|---|---|---|---|
| 3,441,009 | 4/1969 | Rafanelli | 123/90.15 |
| 3,683,875 | 8/1972 | Chadwick | 123/90.15 |
| 3,888,217 | 6/1975 | Hisserich | 123/90.31 |
| 4,484,543 | 11/1984 | Maxey | 123/90.15 |
| 4,715,333 | 12/1987 | Oyaizu | 123/90.31 |
| 4,716,864 | 1/1988 | Binder | 123/90.31 |
| 4,726,331 | 2/1988 | Oyaizu | 123/90.15 |
| 4,862,845 | 9/1989 | Butterfield et al. | 123/90.15 |
| 4,878,461 | 11/1989 | Sapienza, IV et al. | 123/90.15 |
| 5,002,023 | 3/1991 | Butterfield et al. | 123/90.15 |

FOREIGN PATENT DOCUMENTS

| | | | |
|---|---|---|---|
| 3506106 | 8/1985 | Fed. Rep. of Germany | 123/90.15 |
| 3509094 | 10/1985 | Fed. Rep. of Germany | 123/90.15 |
| 79046 | 5/1984 | Japan | 123/90.15 |

OTHER PUBLICATIONS

"System for Automatic Variation of Phase Between Two Camshafts, Inserted Into a 'Cassette Module', With Sachs-Huret Chain"-presented in or about 1983.

*Primary Examiner*—E. Rollins Cross
*Assistant Examiner*—Weilun Lo

[57] ABSTRACT

A driveshaft in the form of a crankshaft (12) or a camshaft (212) drives a camshaft (16, 216) by means of a chain (20, 220) which is trained around a sprocket (14, 214) on the driveshaft and another sprocket (18, 218) on the driven camshaft. The driven camshaft is selectively advanced or retarded in its position by lengthening or shortening one portion (20*a*, 220*a*) of the chain and simultaneously lengthening or shortening another portion (20*b*, 220*b*) thereof by extending one hydraulic tensioning device (22, 122, 222, 322) and simultaneously retracting another hydraulic tensioning device (24, 124, 224, 324). A spool valve member (50) is controllably positioned within a valve body (48), in response to instructions from an engine control unit (58) which acts through a pulse width modulated solenoid (56) to increase or decrease a load acting on one end of the spool, to permit or prevent hydraulic fluid from flowing from one tensioner to another as a result of a pressure differential between the tensioners. The pressure differential exists as a result of torque reversals in the driven camshaft during its normal rotation, the torque reversals having the effect of changing the levels of tension within the portions of the chain that are engaged by the tensioners.

13 Claims, 7 Drawing Sheets

VARIABLE CAMSHAFT TIMING SYSTEM UTILIZING CHANGES IN LENGTH OF PORTIONS OF A CHAIN OR BELT

FIELD OF THE INVENTION

This invention relates to a variable camshaft timing system for an automotive engine in which the phase or circumferential position of a camshaft is varied relative to that of a crankshaft, and possibly also to one or more other camshafts, by varying the lengths of the portions of a chain or belt which interconnects the camshaft(s) or the camshaft(s) and the crankshaft.

BACKGROUND OF THE INVENTION

Our prior U.S. Pat. No. 5,002,023, the disclosure of which is hereby incorporated by reference, describes a VCT system in which a camshaft is connected to a crankshaft by a chain or belt whose portions between the connected elements do not undergo appreciable length changes during the rotation of the camshaft, notwithstanding the torque pulsations experienced by the camshaft during its normal operation and the resulting pulsations in tension within the chain or belt. However, it is known that camshaft timing relative to a crankshaft can be accomplished by changing the lengths of the various portions of the chain or belt which is trained around the sprockets or pulleys on the camshaft(s) and crankshaft, respectively, and various engine and vehicle manufacturers have a preference for this technique as a technique for accomplishing camshaft phase variations, that is, variations in camshaft position relative to crankshaft position. Prior art chain length variation VCT systems are described, for example, in our prior U.S. Pat. No. 4,862,845 and in U.S. Pat. No. 3,683,875 (Chadwick).

Known prior art chain length variation VCT systems, such as those described in the foregoing references, all require an active, separately actuated device to vary the lengths of the portions of a chain or belt between a sprocket or pulley on a camshaft and a sprocket or pulley on a crankshaft. In an hydraulically operated system utilizing engine lubricating oil as the hydraulic fluid, this can be done by using the engine oil lubricating pump to operate the VCT chain length variation devices, but it adds greatly to the required size of the pump, especially in view of the rapid response times that are required in modern VCT systems.

SUMMARY OF THE INVENTION

According to the present invention, a variable chain or belt length VCT device is made self-actuating by using normal variations in tension within the chain or belt, with suitable controls, to permit or prevent the flow of hydraulic fluid out of one hydraulic device which acts to vary the length in one portion of the chain or belt into a second, oppositely acting hydraulic device in which the hydraulic pressure is lower and which acts in unison with the first device to vary the length in another portion of the chain or belt to maintain a constant total length of chain or belt.

Hydraulic fluid, preferably in the form of engine lubricating oil, is transferred from one of the hydraulic devices to the other of the hydraulic devices as a result of a pressure differential between the devices when a control valve is positioned to permit such transfer. The hydraulic pressure differential between the devices occurs as a result of differences in tension between various portions of the chain or belt, one portion of which imposes a load on one of the hydraulic devices and another portion of which imposes a load on the other of the hydraulic devices. At any given time during the rotation of a camshaft, one portion of the chain or belt or which is trained around such camshaft will be at a higher tension than another portion, and the identity of these portions changes from time to time during each rotation of the camshaft as a result of the constantly changing attitude of each camshaft valve operating cam relative to the follower of the engine valve which is operated by such cam. This phenomenon introduces oppositely directed torque pulsations into the camshaft during each of its rotations as is explained in the aforesaid U.S. Pat. No. 5,002,023.

The chain or belt section lengthening or shortening devices of the present invention act in unison to increase or decrease the length of the portion of the chain or belt in the higher tension side of a driven member, such as a camshaft in an automotive engine, and to correspondingly decrease or increase the length of the portion thereof on the lower tension side of the driven member, it being noted as was pointed out above, that the identity of the higher and lower tension sides of the driven member vary from portion to portion during each revolution thereof. When the VCT system of the present invention is being controlled to advance the phase of a driven camshaft relative to a driving camshaft, for example, one of the devices will be controlled to permit an increase in the length of a portion of the chain or belt which interconnects the crankshaft and camshaft only when the hydraulic fluid in that device is at a lower pressure than the hydraulic fluid in the other device, and this condition will only occur during a portion of each rotation of the camshaft when the direction of torque is in a given direction. During another portion of the rotation of the camshaft, after a reversal of the direction of torque in the camshaft, the hydraulic pressure in the one of the devices will be greater than the hydraulic pressure in the other of the devices, and no change in the phase of the camshaft relative to the crankshaft will occur. Conversely, an increase in the length of the other portion of the chain or belt will occur only during the times when the control system has been changed to operate to retard the camshaft phase relative to the crankshaft, and this will only occur when the torque in the camshaft is in the opposite direction. In any case, by using a naturally occurring hydraulic pressure differential in the hydraulic devices to actuate the changes in lengths in the various portions of the chain or belt to accomplish camshaft phase adjustment, no significant additional capacity load is placed on the engine lubricating oil pump, and no additional hydraulic prime mover is required. Further, in a VCT system according to the present invention, camshaft phase adjustment can be accomplished very rapidly, and such a VCT system is capable of being controlled to operate in a continuously variable manner, whereas prior art, variable chain or belt length VCT systems can operate only in a two-position manner, namely fully advanced and fully retarded.

Accordingly, it is an object of the present invention to provide an improved VCT system of the type in which the phase adjustment of a camshaft relative to a crankshaft is accomplished by changing the lengths of the portions of a chain or belt which interconnect the camshaft and the crankshaft. More particularly, it is an object of the present invention to provide a self-actuating VCT system of the foregoing type.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1A:
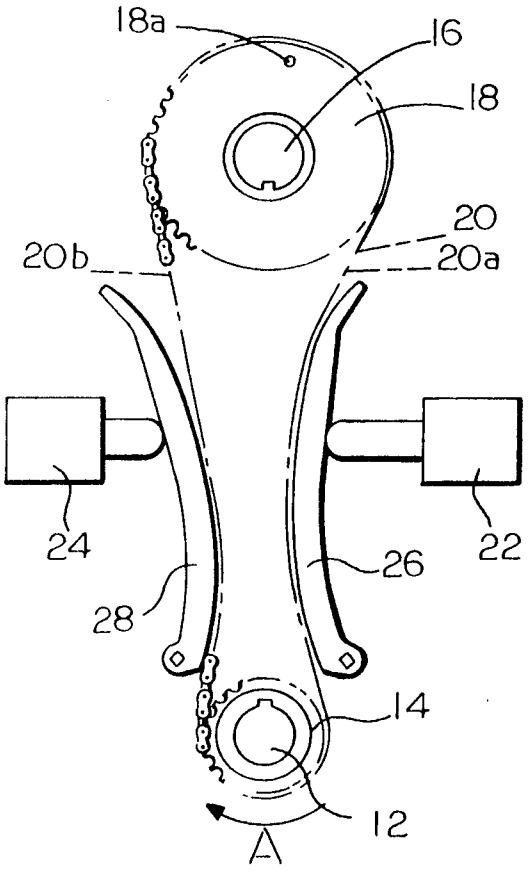
FIG. 1A is a schematic view of the preferred embodiment of a variable camshaft timing system of the present invention in the fully advanced phase of a driven camshaft relative to a driving crankshaft which drives the camshaft by means of a chain drive.
Figure 1B:
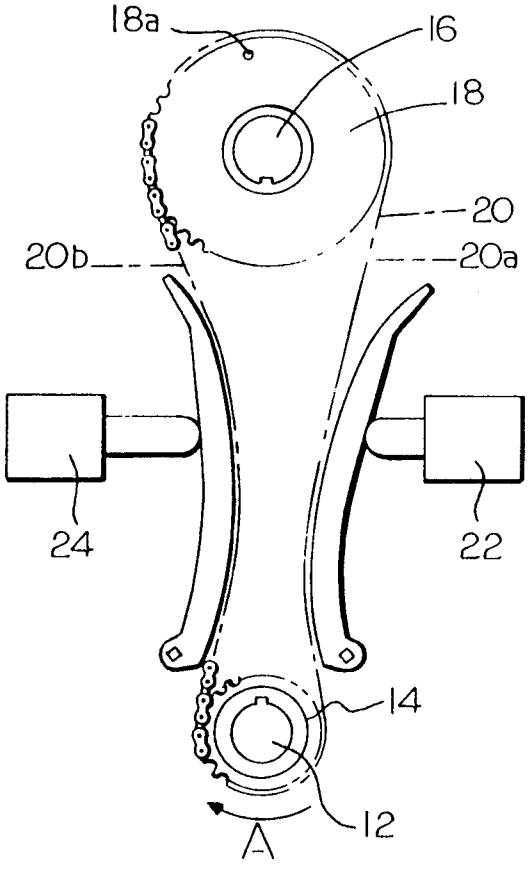
FIG. 1B is a schematic view of the variable camshaft timing system of FIG. 1A in the fully retarded position of the camshaft relative to the crankshaft.

As is schematically illustrated in FIGS. 1A and 1B, a rotary crankshaft 12 of an automotive engine, otherwise not shown, has a sprocket 14 keyed thereto, and acts as a driving member in driving a camshaft 16, whose axis of rotation, namely its longitudinal central axis, extends parallel to the axis of rotation of the crankshaft 12, whose axis of rotation is also its longitudinal central axis. The camshaft 16 also has a sprocket keyed thereto, namely the sprocket 18. Rotary motion is transmitted from the sprocket 14 to the sprocket 18 by a chain 20 which is trained around each of the sprockets 14 and 18. It is to be noted that a cogged timing belt can be substituted for the chain 20, if desired, in which case suitable pulleys need to be substituted for the sprockets 14, 18, as some vehicle and engine manufacturers do have a preference for a belt driven engine as opposed to a chain driven engine of the type illustrated.

In the illustrated arrangement, the chain 20 has two major portions, namely portions 20*a*, 20*b*, respectively, the portion 20*a* moving in a direction from the camshaft 16 to the crankshaft 12 when the crankshaft is rotating in the direction of the arcuate arrow A and the portion 20*b* moving in a direction from the crankshaft 12 to the camshaft 16 during such condition of rotation. In any case, the portion 20*a* of the chain 20 is maintained under tension by an hydraulic tensioner 22, for example, an hydraulic cylinder, which is otherwise schematically illustrated. Further, the portion 20*b* of the chain 20 is maintained under tension by an hydraulic tensioner 24 which is similar in construction and function to the tensioner 22, it being noted that the tensioners 22 and 24 act directly on pivoted shoes 26, 28, respectively, whose chain contacting surfaces are curved to conform to the arcs of the chain portions 20*a*, 20*b*, respectively, in order to achieve a more equal distribution of the loads from the tensioners 22, 24 on the chain portions 20*a*, 20*b*.

The pressure of the hydraulic fluid in the tensioners 22, 24 will be a function of the levels of tension within the chain portions 20*a*, 20*b*, respectively, by virtue of the loads placed on the tensioners 22, 24 by the shoes 26, 28, respectively. Since the camshaft 16 will experience reversals in the direction of torque therein during each of its directions, as is explained in our aforesaid U.S. Pat. No. 5,002,003, during one portion of each rotation of the camshaft 16, the tension in the portion 20*a* of the chain 20 will be greater than the tension in the portion 20*b*, and upon a reversal of the direction of torque in the camshaft 16, the tension in the portion 20*a* of the chain 20 will be less than the tension in the portion 20*b*. This phenomenon can be used to change the phase of the camshaft 16 relative to the crankshaft 12 from its fully advanced phase, as is illustrated in FIG. 1A, to its fully retarded phase, as is illustrated in FIG. 1B, or to any phase therebetween, not illustrated Compare, for example, the position of a timing dot 18*a* on the sprocket 18 in the FIG. 1A position of the sprocket 18 relative to the position of the timing dot 18*a* in the FIG. 1B position of the sprocket 18.

Figure 2:
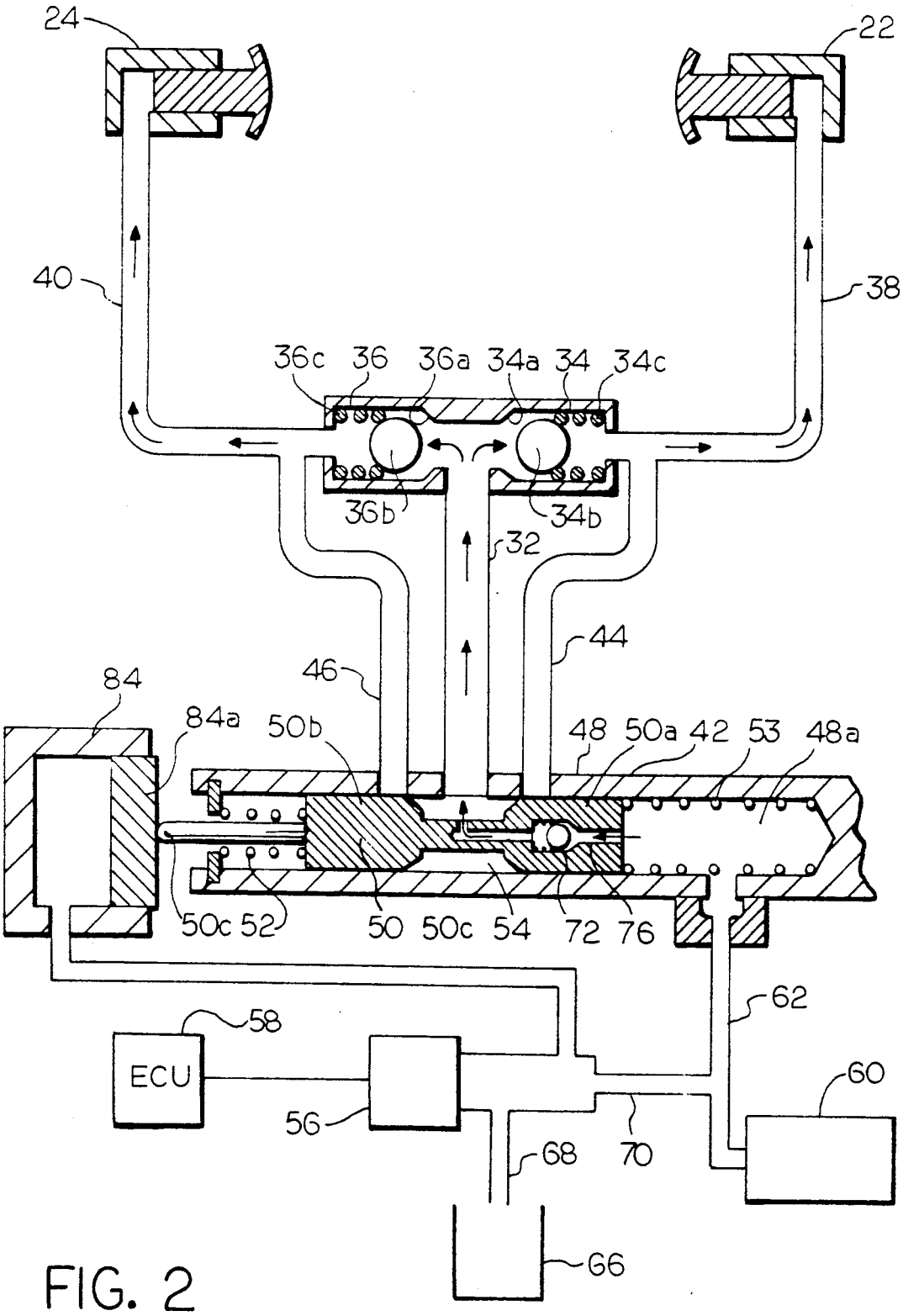
FIG. 2 is a schematic view of the hydraulic equipment of the variable camshaft timing system according to the preferred embodiment of the present invention and illustrates a condition where the camshaft phase is being maintained in a given position between its fully advanced position and its fully retarded position.
Figure 3:
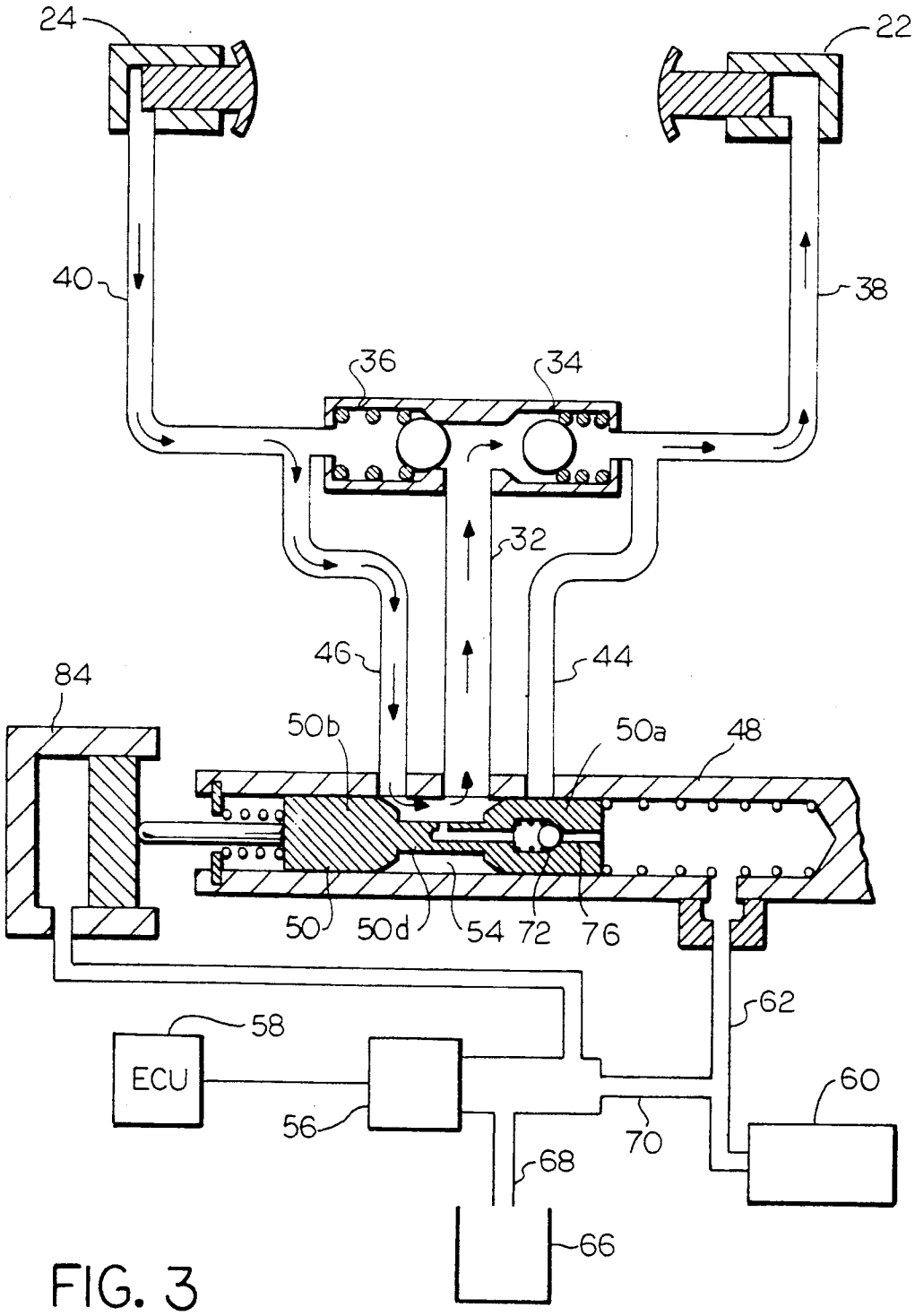
FIG. 3 is a schematic view similar to FIG. 2 in which the camshaft phase is shifting in the direction of its advanced position.
Figure 4:
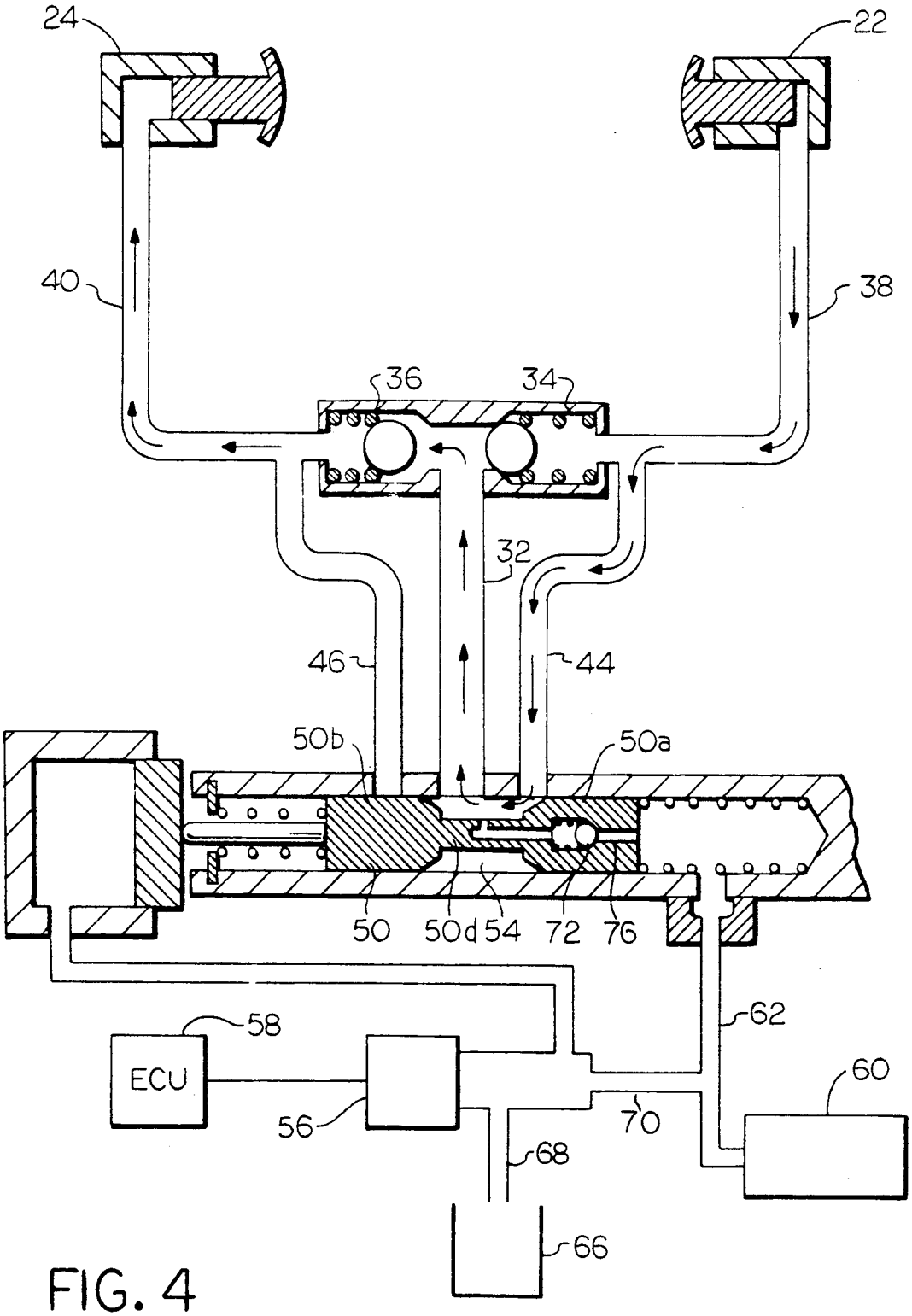
FIG. 4 is a schematic view similar to FIGS. 2 and 3 in which the camshaft phase is shifting in the direction of its fully retarded position.

The advancing or retarding of the phase or position of the camshaft 16 relative to the crankshaft 12 can be controllably achieved by transferring hydraulic fluid from one of the tensioners 22, 24 to the other based on the direction of the differential in the pressures of the hydraulic fluid therein, by way of the hydraulic system which is illustrated in FIGS. 2–4. As is shown in FIGS. 2–4, the hydraulic fluid in the tensioners 22, 24, which preferably is in the form of engine lubricating oil, flows into the tensioners 22, 24 by way of a common inlet line 32. The inlet line 32 terminates at a juncture between opposed check valves 34 and 36 which are connected to the tensioners 22, 24, respectively, by branch lines 38 and 40, respectively. The check valves 34 and 36 have annular seats 34*a* and 36*a* to permit the flow of hydraulic fluid through the check valves 34 and 36 into the tensioners 22, 24, respectively. The return flow of hydraulic fluid through the check valves 34 and 36, however, is blocked by floating balls 34*b* and 36*b*, respectively, which are resiliently urged against the seats 34*a* and 36*a*, respectively, by springs 34*c*, 36*c*, respectively. The check valves 34, 36, thus permit the initial filling of the tensioners 22, 24 and provide for a continuous supply of make-up hydraulic fluid to compensate for leakage therefrom. Hydraulic fluid enters the line 32 by way of a spool valve 42, and hydraulic fluid is returned to the spool valve 42 from the tensioners 22, 24 by return lines 44 and 46, respectively.

The spool valve 42 is made up of a cylindrical member 48 and a spool 50 which is slidable to and for within the member 48. The spool 50 has cylindrical lands 50*a*, 50*b* on opposed ends thereof, and the lands 50*a*, 50*b*, which fit snugly within the member 48, are positioned so that the land 50*b* will block the exit of hydraulic fluid from the return line 46, as is shown in FIG. 4, where the camshaft 16 is shifting in the direction of its retarded position, or the land 50*a* will block the exit of hydraulic fluid from the return line 44, as is shown in FIG. 3, where the camshaft 16 is shifting in the direction of its advanced position, or the lands 50*a* and 50*b* will block the exit of hydraulic fluid from both the return lines 44 and 46, as is shown in FIG. 2, where the camshaft 16 is being maintained in a desired position, its fully advanced position, its fully retarded position, or some intermediate position.

The position of the spool 50 within the member 48 is influenced by a spring 52 which acts on the end of the land 50*b*. Thus, the spring 52 resiliently urges the spool 50 to right, in the orientation illustrated in FIGS. 2–4. Further, the spool is also urged to the right by hydraulic pressure within a control pressure cylinder 84 whose piston 84*a* bears against an extension 50*c* of the spool 50. The position of the spool 50 within the member 48 is further influenced by a supply of pressurized hydraulic fluid within a portion 48*a* of the member 48, on the outside of the land 50*a*, and by a spring which acts on the end of the land 50*a*, which combine to urge the spool 50 to the left. The retraction of one or another of the tensioners 22, 24, with a resulting extension of the other of such tensioners, results from the unblocking of either the return line 44 or the return line 46, as heretofore described, since the hydraulic fluid which passes through such return line will flow into the inlet line 32 by way of an annular space 54 which is defined by the inside of the member 98 and the outside of a reduced diameter portion 50*d* of the spool 50, which is positioned between the lands 50*a* and 50*b*. Thus, the expansion of the expanding tensioner 22 or 24 results from a transfer of hydraulic fluid directly thereto from the contracting tensioner 22 or 24, and does not add to the required size of the engine lubricating oil pump or require a separate hydraulic pump to achieve such a result.

The pressure within the cylinder 84, whose piston 84*a* has a substantially greater surface area than the surface area of the end of the lobe 50*a* of the spool, is controlled at a lower pressure than the pressure within the portion 48*a* by a pressure control signal from a controller 56, preferably of the pulse width modulated type (PWM), in response to a control signal from an electronic engine control unit (ECU) 58, shown schematically, which may be of conventional construction. The controller 56 receives engine oil from the main oil gallery 60 of the engine through an inlet line 70. Further, engine oil from the gallery is delivered at full pressure to the portion 48*a* of the cylindrical member 48 through a supply line 62. Spent oil from the controller 56 is returned by way of an outlet line 68 to a sump 66. The make-up oil for the tensioners 22, 24 to compensate for any oil leakage therefrom comes from the portion 48*a* of the cylindrical member 48 by way of a small, internal passage 76 within the spool 50, from the portion 48*a* of the cylindrical member 48 to the annular space 54, from which it can flow to the tensioners 22, 24 by way of the inlet line 32. A check valve 72 is placed in the internal passage 76 to block the flow of oil from the space 54 to the portion 48*a* of the cylindrical member 48.

When the ratio of the pressure within the cylinder 84 to the pressure within the portion 48*a* is the inverse of the ratio of the area of the piston 84*a* to the area of the end of the land 50*a*, the hydraulic loads on the spool 50 will be in balance. When these hydraulic loads are in balance, the springs 52 and 53, if they are designed to impose equal loads on the spool 50 in the FIG. 2, centered or null position of the spool 50, will rapidly return the spool 50 to its FIG. 2 position. The spool 50 will then be caused to move to the right or left by increasing or decreasing the duty cycle of the solenoid 56, as it is instructed by the controller 58.

The tensioners 22, 24 are arranged to resist the positive and negative torque pulses in the camshaft 16, and the resulting variations in the tension patterns in the chain portions 20*a*, 20*b*, and are alternatively pressurized thereby because every force is resisted by an equal and oppositely directed reaction force. Such cyclical pressurizing of the tensioners 22, 24 is converted to hydraulic flow, and to a change in length of the portions 20*a*, 20*b* of the chain 20 relative to one another, by the controlled positioning of the spool 50 within the cylindrical member of the spool valve 42 and by the flow direction sensitivity of the check valves 34 and 36.

Referring to FIGS. 1A, 1B and 3, the tensioner 22 is pressurized during positive torque pulses in the camshaft 16, when the tension in the portion 20*a* of the chain 20 exceeds that in the portion 20*b*, and the tensioner 24 is pressurized during negative torque pulses. The position of the spool 50 allows hydraulic fluid to flow out of the retracting tensioner 24 during a negative torque pulse through the passage 40, the passage 46, and the cavity 54, and through the passage 32, the check valve 34 and the passage 38 into the tensioner 22 which is extending. When the torque pulse becomes positive, the tensioner 22 is pressurized, but the fluid is not allowed to flow out of the tensioner 22 because the check valve 34 closes and blocks backflow through the passage 32 and the land 50*a* blocks fluid flow through the passage 44. Therefore, with the tensioner 22 being allowed to extend and the tensioner 24 only being allowed to retract, the variable camshaft timing mechanism causes the camshaft 16 to move only in the advanced timing direction relative to the position of the crankshaft 12 in the FIG. 3 position of the spool 50.

FIG. 4 illustrates a condition in which the position of the camshaft 16 is being retarded relative to the position of the crankshaft 12. The position of the spool 50 allows hydraulic fluid to flow out of the retracting tensioner 22, during a positive torque pulse, through the passage 38, the passage 44, the cavity 54, the passage 32, the check valve 36 and the passage 38 into the extending tensioner 24. When the torque in the crankshaft 16 becomes negative, the tensioner 24 is pressurized relative to the tensioner 22, but the fluid is not allowed to flow out of the tensioner 24 because the check valve 36 is closed and blocks backflow through the passage 32 and the land 50*b* blocks fluid flow through passage 46. Therefore, with the tensioner 24 being allowed to extend and the tensioner 22 only being allowed to retract, the variable camshaft timing mechanism causes the camshaft 16 to move only in the retarded timing direction relative to the position of the crankshaft 12 when the spool 50 is in its FIG. 4 position.

FIG. 2 illustrates a condition in which the spool 50 is centered in its neutral or null position. The land 50*b* prevents hydraulic fluid from exiting the tensioner 24 by blocking the exit passage 46. The check valve 36 also prevents fluid from leaving the tensioner 24, but allows makeup fluid to flow into tensioner 24 to compensate for any leakage. Similarly, the land 50*a* prevents hydraulic fluid from exiting the tensioner 22 by blocking the exit passage 44. The check valve 34 also prevents fluid from leaving the tensioner 22, but allows makeup fluid to flow into the tensioner 22 to compensate for any leakage. Thus, by preventing flow from both tensioners, which prevents the tensioners 22 and 24 from retracting, the camshaft is "locked" in a selected intermediate position of the camshaft 16 relative to the crankshaft 12.

As is illustrated in FIGS. 3 and 4, the spool valve 50 is in one or another of its fully open positions, allowing the hydraulic fluid to flow at the maximum rate of change of the camshaft timing relative to the crankshaft If desired, the spool valve 50 can be partially opened, allowing the hydraulic fluid to flow at a reduced rate, limiting the rate of change of camshaft timing Therefore, camshaft timing position and the rate of change of camshaft timing position are controllable by the same valve.

Figure 5A:
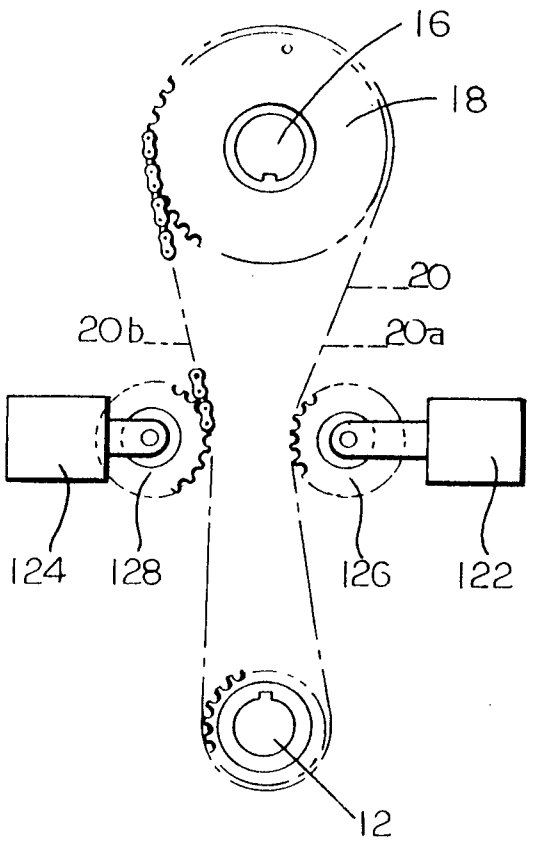
FIG. 5A is a view similar to FIG. 1A of an alternative embodiment of a variable camshaft timing system in the fully advanced position of the camshaft thereof.
Figure 5B:
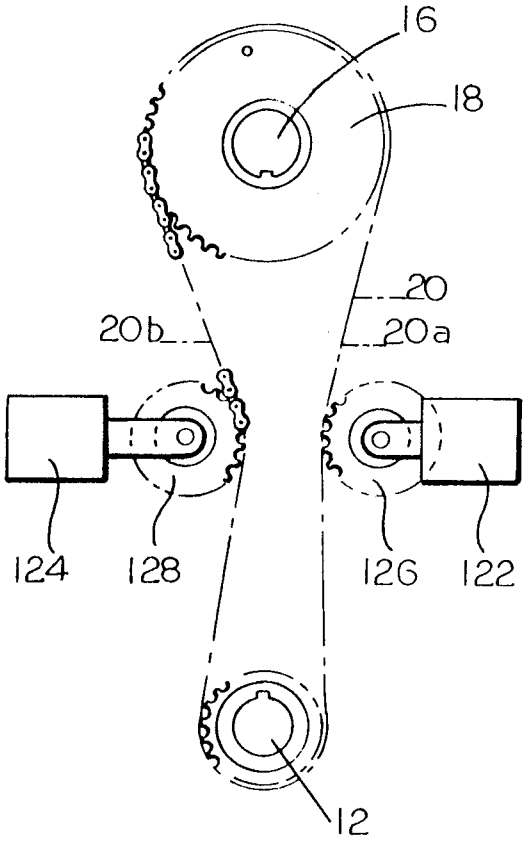
FIG. 5B is a view similar to FIG. 1B of the variable camshaft timing system of FIG. 5A in the fully retarded position of the camshaft thereof.

The embodiment of FIGS. 5A and 5B is generally the same as the embodiment of FIGS. 1A and 1B except that the tensioner 22 and the shoe 26 are replaced by an hydraulic tensioner 122 which carries a rotatable, chain engaging sprocket 126 at its free end. The tensioner 24 and the shoe 28 are replaced by an hydraulic tensioner 124 which carries a chain engaging sprocket 128 at its free end. The sprockets 126, 128 introduce less frictional drag into the portions 20*a*, 20*b*, respectively, of the chain 20 than the shoes 26, 28 of the embodiment of FIGS. 1A and 1B. The tensioners 122, 124 are hydraulically interconnected as in the case of the tensioners 22, 24 of the embodiment of FIGS. 1A and 1B by means otherwise not shown.

Figure 6B:
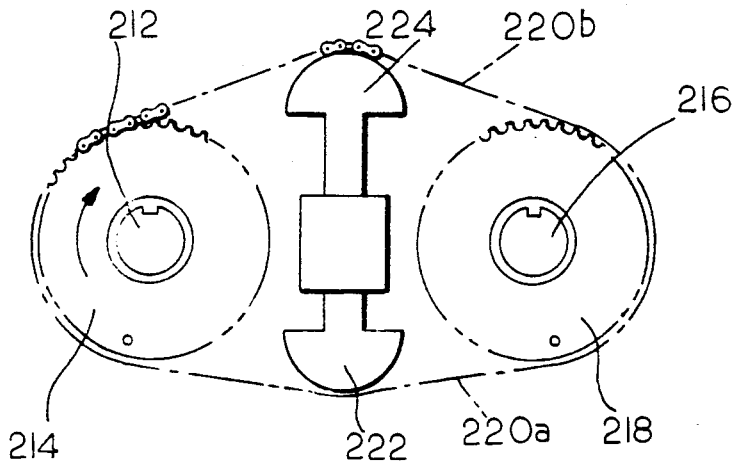
FIG. 6B is a view similar to FIG. 1B of the variable camshaft timing system of FIG. 6A in the fully retarded position of the variable camshaft thereof.
Figure 6A:
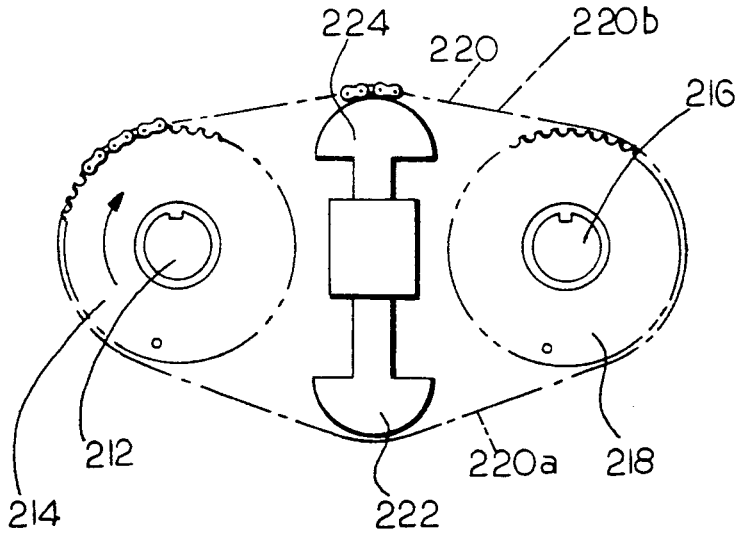
FIG. 6A is a view similar to FIG. 1A of an embodiment of a system for varying the timing of a camshaft relative to that of another camshaft in the fully advanced position of the variable camshaft thereof.

In the embodiment of FIGS. 6A and 6B, there is provided a driving member 212 which is a first camshaft, and a driven member 216, which is a second camshaft. The driving member 212 carries a sprocket 214 which is keyed thereto, the driven member 216 carries a sprocket 218 which is keyed thereto, and a chain 220 which is trained around the sprockets 214, 218. An hydraulic tensioner 222 acts to advance the phase of the driven member 216 relative to the driving member 212 by extending to lengthen a portion 220*a* of the chain 220 while a second hydraulic tensioner 224 is retracting to permit a second portion 220*b* of the chain 220 to shorten. To retard the phase of the driven member 216, the second hydraulic tensioner 224 is extended and the first hydraulic tensioner 222 is retracted. The tensioners 222, 224 are hydraulically interconnected, by means otherwise not shown, as in the case of the tensioners 22, 24 of the embodiment of FIGS. 1A and 1B.

Figure 7B:
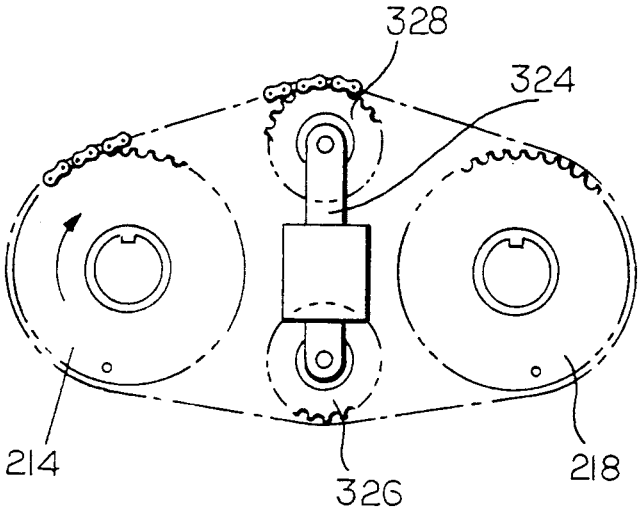
FIG. 7B is a view similar to FIG. 6B of the variable camshaft timing system of FIG. 7A in the fully retarded position of the variable camshaft thereof
Figure 7A:
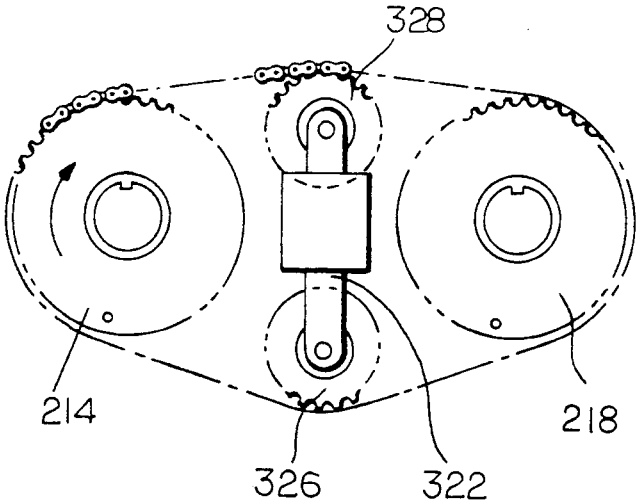
FIG. 7A is a view similar to FIG. 6A of an alternative embodiment of a multiple camshaft, variable camshaft timing system in the fully advanced position of the variable camshaft thereof.

The embodiment of FIGS. 7A and 7B is generally the same as the embodiment of FIGS. 6A and 6B except that the tensioner 222 is replaced by a tensioner 322 which carries a rotatable, chain engaging sprocket 326 at its free end and the tensioner 224 is replaced by a tensioner 324 which carries a chain engaging sprocket 228 at its free end. The tensioners 322, 324 are also hydraulically interconnected as in the case of the tensioners 22, 24 of the embodiment of FIGS. 1A and 1B, by means otherwise not shown.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In an internal combustion engine having a first rotatable member and a second rotatable member, one of the rotatable members being position variable relative to the other and being subject to reversals in the direction of torque therein during the rotation thereof, endless drive means interconnecting the first and second rotatable members for simultaneous rotation thereof, said endless drive means having a first portion under tension extending from one of the rotatable members to the other and a second portion under tension extending from the other of the rotatable members to the one, the tension in one of the first and second portions being greater than the tension in the other of the first and second portions when the torque in the one of the rotatable members is in a given direction and the tension in the other of the first and second portions being greater than the tension in the one of the first and second portions when the torque in the one of the rotatable members is in an opposed direction, first tensioning means acting on the first portion to selectively increase or decrease the length thereof and second tensioning means acting on the second portion to selectively increase or decrease the length thereof, the method comprising:

activating the operation of the first tensioning means and the second tensioning means in reaction to torque reversals in the one of the rotatable members to selectively increase the length of one of the first portion and the second portion and to simultaneously decrease the length of the other of the first portion and the second portion in reaction to torque reversals in the one of the rotatable members.

2. A method according to claim 1 wherein the one of the rotatable members is a camshaft and wherein the other of the rotatable members is a crankshaft.

3. A method according to claim 1 wherein each of the first and second rotatable members is a camshaft.

4. A method according to claim 1 wherein the first and second rotatable members rotate about spaced apart axes that extend generally parallel to one another.

5. An internal combustion engine comprising:

a first rotatable member, said first rotatable member being rotatable about a first axis;

a second rotatable member, said second rotatable member being rotatable about a second axis, said second axis being spaced from and extending generally parallel to said first axis, said second rotatable member further being position variable about its axis of rotation with respect to the first rotatable member;

endless drive means interconnecting said first rotatable member and said second rotatable member for simultaneous rotation of the rotatable members, said endless drive means having a first portion extending between a first location on the first rotatable member and a first location on the second rotatable member and a second portion extending between a second location on the first rotatable member and a second location on the second rotatable member;

first hydraulic tensioning means, said first tensioning means being extensible and retractable and acting on said first portion of said drive means to maintain tension therein;

second hydraulic tensioning means, said second tensioning means being extensible and retractable and acting on said second portion of said drive means to maintain tension therein; and means for transferring hydraulic fluid from one of said first tensioning means and said second tensioning means to the other of said first tensioning means and said second tensioning means to increase the length of one of said first portion and said second portion and decrease the length of the other of said first portion and said portion and thereby change the position of said second rotatable member about its axis of rotation relative to the first rotatable member.

6. An internal combustion engine according to claim 5 wherein said second rotatable member is subject to torque reversals during the rotation thereof, one of said first portion and said second portion being higher in tension than the other of said first portion and said second portion when the torque in said second rotatable member is in a given direction, the other of said first portion and said second portion being higher in tension than the one of said first portion and said second portion when the torque in said second rotatable member is in an opposed direction, and wherein said means for transferring hydraulic fluid includes control means for selectively permitting or substantially preventing hydraulic fluid from flowing from one of said first tensioning means and said second tensioning means to the other of said first tensioning means and second tensioning means in reaction to a condition of tension in one of said first portion and said second portion which is greater than the tension in the other of said first portion and said second portion.

7. An internal combustion engine according to claim 5 wherein said first rotatable member is a crankshaft and wherein said second rotatable member is a camshaft

8. An internal combustion engine according to claim 5 wherein each of said first rotatable member and second rotatable member is a camshaft.

9. An internal combustion engine according to claim 5 wherein said endless drive means includes a first sprocket keyed to said first rotatable member, a second sprocket keyed to said second rotatable member, and an endless chain trained around said first sprocket and said second sprocket.

10. An internal combustion engine according to claim 5 wherein said first tensioner means comprises a first pivoted shoe having an arcuate face, said arcuate face of said first pivoted shoe directly engaging said first portion of said claim in an arcuate pattern.

11. An internal combustion engine according to claim 10 wherein said second tensioner means comprises a second pivoted shoe having an arcuate face, said arcuate face of said second pivoted shoe directly engaging said second portion of said claim in an arcuate pattern.

12. An internal combustion engine according to claim 5 wherein said first tensioner means comprises a first rotatable follower sprocket, said first rotatable follower sprocket directly engaging said first portion and being caused to rotate by the movement of said first portion as a result of the rotation of said first rotatable member and said second rotatable member.

13. An internal combustion engine according to claim 12 wherein said second tensioning means comprises a second rotatable follower sprocket directly engaging said second portion and being caused to rotate by the movement of said second portion as a result of the rotation of said first rotatable member and said second rotatable member.

* * * * *